US006712059B2

(12) United States Patent
Donovan

(10) Patent No.: US 6,712,059 B2
(45) Date of Patent: Mar. 30, 2004

(54) FINNED VIBRATION DAMPER FOR ARCHERY BOW

(76) Inventor: Robert Lee Donovan, 17743 Rimrock Rd., Hayden, ID (US) 83835

( * ) Notice: Subject to any disclaimer, the term of this patent is extended or adjusted under 35 U.S.C. 154(b) by 0 days.

(21) Appl. No.: 10/087,148

(22) Filed: Feb. 28, 2002

(65) Prior Publication Data

US 2003/0159684 A1 Aug. 28, 2003

(51) Int. Cl.[7] ..... F41B 5/20
(52) U.S. Cl. ..... 124/89; 188/378
(58) Field of Search ..... 124/89; 15/188, 15/238; 188/378

(56) References Cited

U.S. PATENT DOCUMENTS

| | | | | |
|---|---|---|---|---|
| 404,588 | A | * | 6/1889 | Bailey |
| 415,026 | A | * | 11/1889 | Cowen et al. |
| 2,604,377 | A | * | 7/1952 | Eames |
| 4,556,042 | A | * | 12/1985 | Izuta ..... 124/89 |
| 5,362,046 | A | | 11/1994 | Sims |
| 5,772,541 | A | | 6/1998 | Buiatti |
| 5,842,933 | A | | 12/1998 | Lewis |
| 5,944,617 | A | | 8/1999 | Falone et al. |
| 5,964,670 | A | | 10/1999 | Cheng |
| 6,021,770 | A | | 2/2000 | Sodaro |
| 6,224,341 | B1 | * | 5/2001 | Fricke |
| 6,257,220 | B1 | * | 7/2001 | McPherson et al. ..... 124/89 |
| 6,298,842 | B1 | * | 10/2001 | Sims |

OTHER PUBLICATIONS

Gerbus, Dan H., Bowrunner: An Incremental Analysis of Curved Composite Beams for Archery Bows, Masters Thesis, University of Idaho, Aug. 1999, Moscow, Idaho, U.S.A.
Advertisement: Limb Saver by Sims Mar. & Apr. Archery Business Magazine, 2000.
Limb Saver by Sims packaging insert.
Printout from website: www.doinker.com 3 pages, dated May 29, 2001.
Advertisement: The Isolator by R&R Enterprises Mar./Apr. 2000 Archery Business magazine.
Advertisement: ShockBlocker by New Archery Products Corp., Mar./Apr. 2000 Archery Business.

* cited by examiner

*Primary Examiner*—John A. Ricci
(74) *Attorney, Agent, or Firm*—Duncan Palmatier

(57) ABSTRACT

Disclosed is a finned vibration damper to damp vibrations in an object, especially in an archery bow. The invention is comprised of a base and a plurality of fins extending up from the base. The vibration damper is made of an elastic, rubbery material, such as an elastomer or elastic polymer. The base of the damper has a bottom surface which can be attached to an object by glue or an adhesive. In an alternative embodiment, the damper has interlocking extensions that allow the damper to be wrapped around and object so that extensions overlap and interlock. In another disclosed embodiment, the damper is a ring with fins extending radially out from a ring base.

15 Claims, 12 Drawing Sheets

NO DAMPER

PRIOR ART
DAMPER

FINNED DAMPER
OF INVENTION

FINNED VIBRATION DAMPER FOR ARCHERY BOW

BACKGROUND OF THE INVENTION

1. Field of the Invention

This invention relates to rubbery dampers designed to reduce vibration and absorb shock in an archery bow. The disclosed invention is a finned damper which is resilient and flexible and may be mounted to any part of an object, such as an archery bow, so that the damper will not interfere with the object's use, yet the damper reduces undesired vibrations generated by and during the object's use. The disclosed invention has been tested and proven to provide more damping than rubber dampers currently available.

2. Discussion of the Prior Art

Archery bows tend to generate undesirable vibrations and noise during use. These can detract from the performance of the bow and the archer. In archery, the archer nocks an arrow and draws his or her bow, hoping to shoot the arrow straight and sure to hit a target some distance away. The drawing of the bow stores potential energy in the bow and bowstring, which when released impart kinetic energy by a forward thrust to the arrow. When the bowstring is released, most of the stored energy is transferred to the arrow, causing the arrow to fly according to the force and direction of the bowstring travel. However, a portion of the energy is not transferred to the arrow, but is instead reflected back into the bow and transferred back to the archer's bowhand. Ideally, all of the stored energy should be transferred to the arrow. But this is not possible due to the physics, mechanics, and dynamics of the bow, bowstring, and arrow system configuration. This returned energy appears to the archer as a recoil, or kick, felt in his or her bow arm. When the bowstring is released, the limbs accelerate forward and engage in a series of rapid vibrations which ultimately die down. This series of vibrations may be so forceful as to affect the flight of the arrow. One way to lessen the effect of these vibrations is through the use of stabilizer rods. Stabilizers are weighted devices which are mounted to the riser area of the bow and are designed to reduce torque and absorb vibration generated upon release. The stabilizers are mounted to the back of the bow (the side which faces the target and faces away from the archer) and help lessen the vibration of the bow limbs. Mechanical dampers are also used to reduce bow vibrations. These mechanical dampers are usually mounted to the front of a bow below the grip. In a conventional mechanical damper, a metal cylinder is filled with oil and a piston in the cylinder is allowed to travel back an forth within the oil-filled cylinder, thereby damping vibrations.

Several patents disclose vibration damping devices for use with sports equipment, hand tools, and other such devices. U.S. Pat. No. 5,362,046 to Sims (1994) shows a vibration damping device for implements which are subject to impact. The Sims patent is disclosed and claimed for use with an "implement", defined as "wielded devices designed to impart and receive impacts", such as golf clubs, baseball bats, tennis rackets, and hammers. See Sims at Col. 1:12–16. However, although the patent is restricted to the wielded devices, the disclosed damper is commercially available and marketed as an archery bow damper, called the "LIMB SAVER". This device has a mushroom-like configuration provided by a head and an integral stem and is fabricated from a soft elastomeric material. The stem is capable of oscillating over a 360° span in directions generally normal to the longitudinal axis of the device. The peripheral part of the head can oscillate around its circumference in directions generally paralleling that axis. For this vibration damping device to function effectively, it is essential that the ratio between the diameter d of the head and length l of the stem be between 5:1 and 1:1. U.S. design Pat. Nos. D436,643 and D445,161, also issued to Sims (2001), show an archery bow shock absorber and a vibration damper, respectively, in the knob and stem configuration.

SUMMARY OF THE INVENTION

It is one of the objects of the present invention to provide a finned vibration damper, made of a resilient elastomeric material, that provides superior damping. It is another object of the present invention to provide a finned vibration damper that will enhance the performance of an archery bow. Another object of the present invention is to provide a finned vibration damper that will reduce vibration of the limb and noise of the bow during use. It is another object of the present invention to provide a finned vibration damper that will reduce the bow's recoil. It is another object of the present invention to provide a finned vibration damper which may be attached to any part or surface of an archery bow. It is another object of the present invention to provide a vibration damper which can conform to the shape of and firmly engages an archery bow limb. Another object of the present invention is to provide a finned vibration damper that will not interfere with the use of the archery bow. Another object of the present invention is to provide a finned vibration damper that is of simple design and economical manufacture and has a long in-service useful life. It is another object of the present invention to provide a finned vibration damper that is easy to install and remove, small and lightweight, inexpensive, and easy to store when not in use.

The invention discloses a finned vibration damper which is made of a resilient and pliable elastomeric material such that the material properties lend themselves to energy absorption. The invention further discloses a vibration damper in which the resilient material is formed into a series of fins which absorb vibration imparted to an archery bow. In one alternative embodiment of the present invention, the damper is formed with a series of fins and a base that extends beyond the fins at each end. The base extensions aid in attachment of the damper by allowing it to be wrapped around any cross-section of the vibrating object, such as an archery bow. In this embodiment the base extensions may be further modified by forming into them a series of interlocking teeth and grooves, which help strengthen the attachment of the damper around a vibrating object, such as a bow's mechanical damper or counterweights. In yet another alternative embodiment of the present invention, the damper is formed in a ring with fins, so that the damper can be stretched over a cylindrical object, such as an archery counterweight or mechanical damper.

DESCRIPTION OF THE INVENTION

Figure 1:
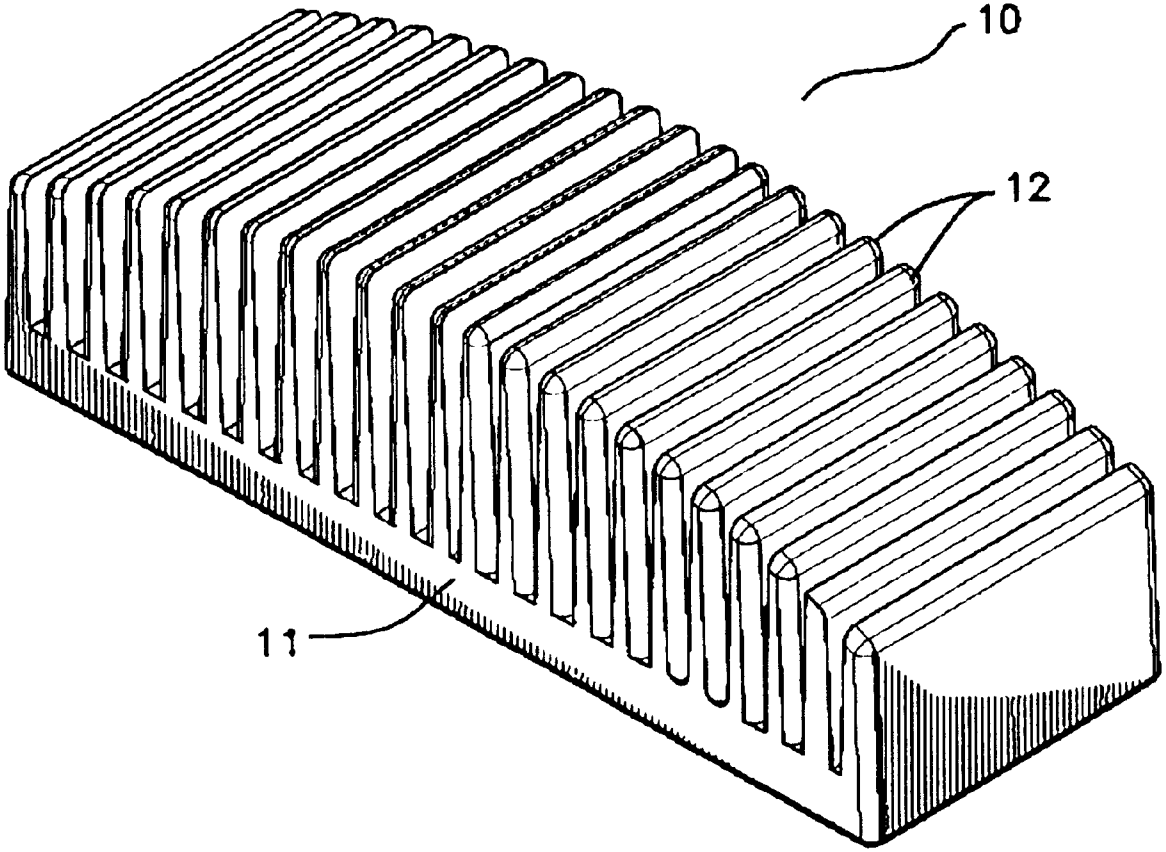
FIG. 1 is an isometric view of one preferred embodiment of the finned damper, seen from the top.
Figure 2:
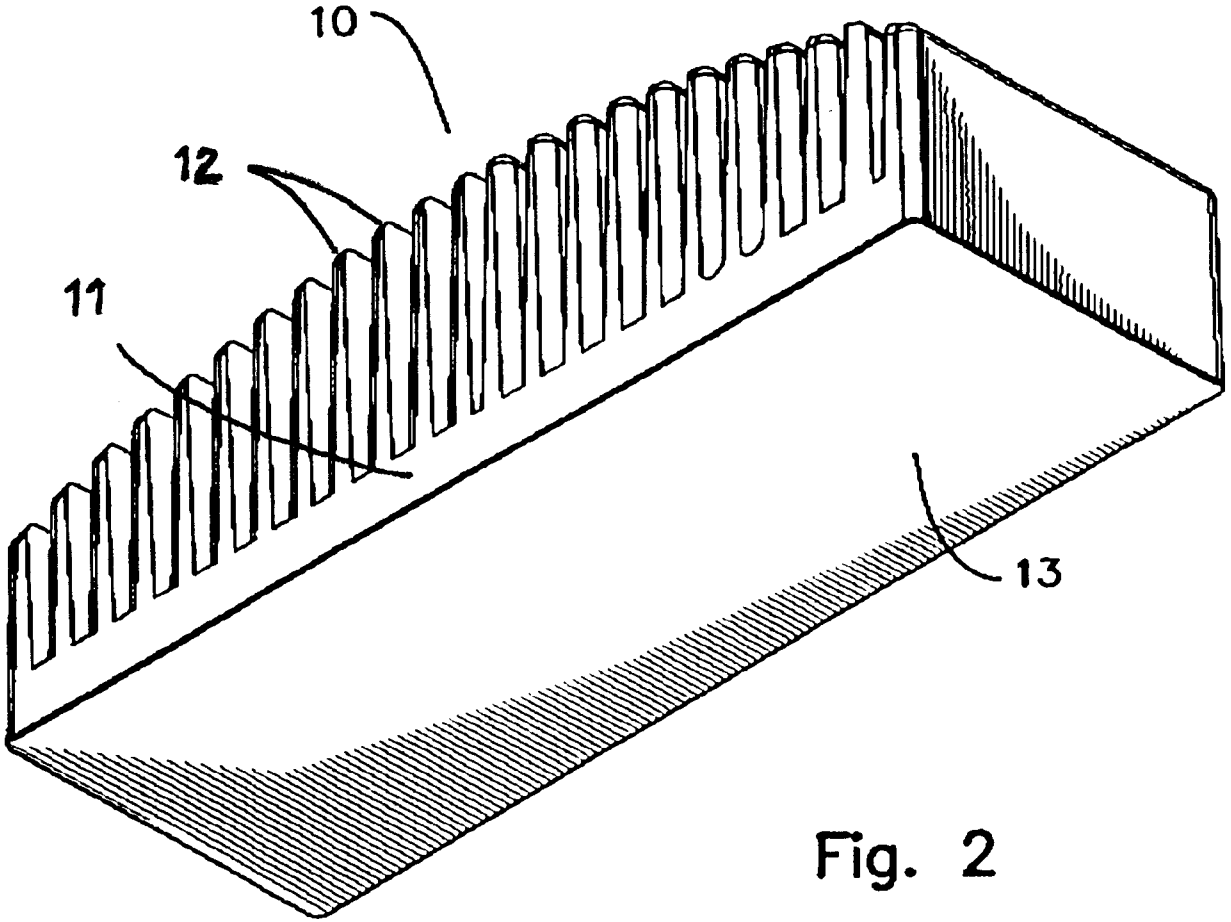
FIG. 2 is another isometric view of the preferred embodiment of the finned damper, seen from the bottom.
Figure 3:
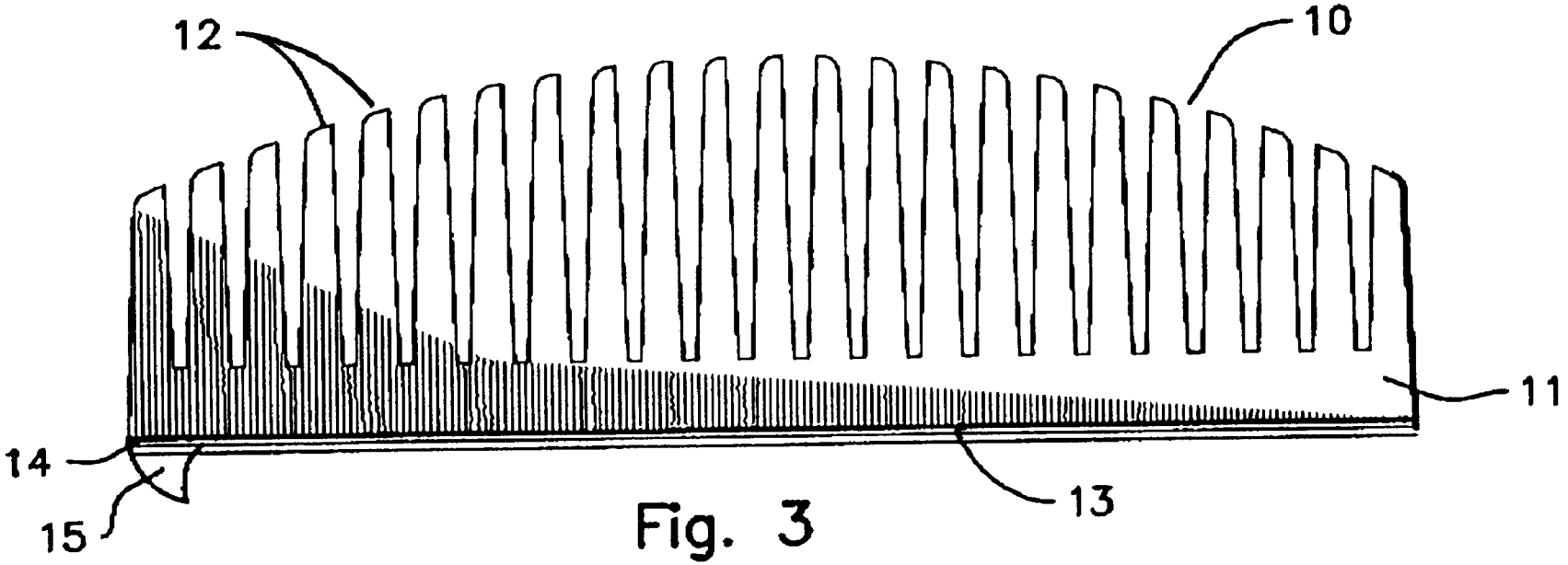
FIG. 3 is an orthogonal view of the preferred embodiment of the finned damper, seen from the side.
Figure 9:
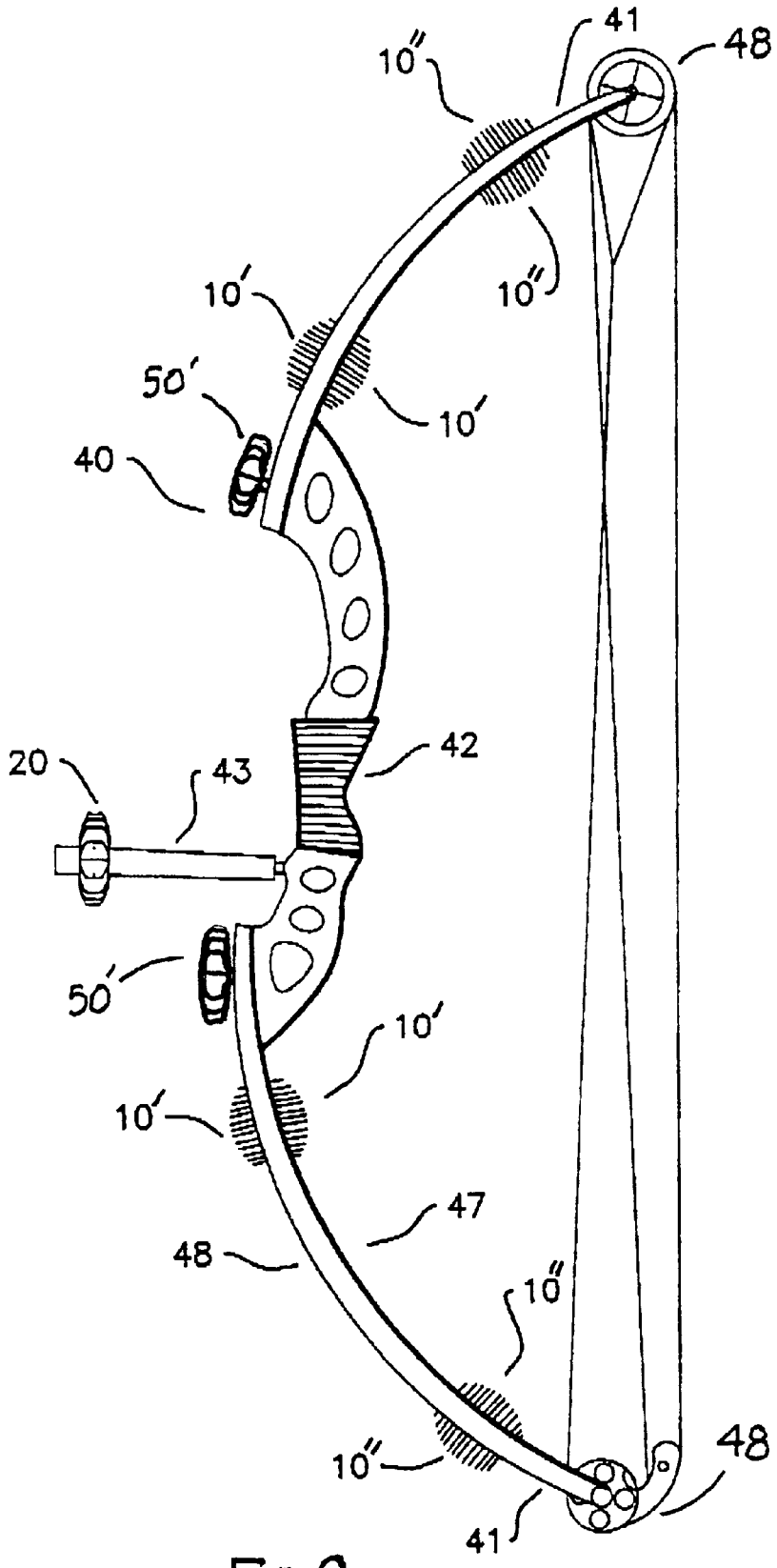
FIG. 9 is a general view of an archery bow with the preferred embodiments shown attached in several possible places.

FIGS. 1, 2, and 3 show one embodiment of the present invention. A finned damper 10 is made of a resilient, elastomeric material, such as rubber, elastomer, and elastic polymers. The damper 10 is molded into a base 11 with a series of fins 12 extending up from it. The embodiment shown in FIGS. 1 through 3 has a rectangular base 11 with a flat bottom 13. For archery bow dampers, the finned damper can be roughly one inch wide, three inches long, and an inch high. These dimensions allow the damper to fit on various parts of the most common bows. For example, as shown in FIG. 9, the finned damper 10 may be mounted to the limb 41 of an archery bow 40, either on the inner 47 or outer 48 surface, and either close to the grip 42, as indicated by 10', or close to the pulleys 48, as indicated by 10". Fins 12 extend up from the base 11. The finned damper 10 may be fixed to an archery bow with conventional adhesives, such as glue or tape with adhesive on both sides. For example, FIG. 3 shows the finned damper 10 with a layer of adhesive 14 on the bottom surface 13. The adhesive is covered by a peel-off strip 15. To fix the finned damper 10 to a bow limb, the strip 15 is peeled off, revealing the adhesive layer 14, then the damper 10 is pressed to the bow limb until the adhesive 14 sticks. The finned damper 10 can be mounted to almost any surface of an archery bow. As additional examples, the finned damper 10 can be fixed on a conventional bow mounted quiver.

Figure 4:
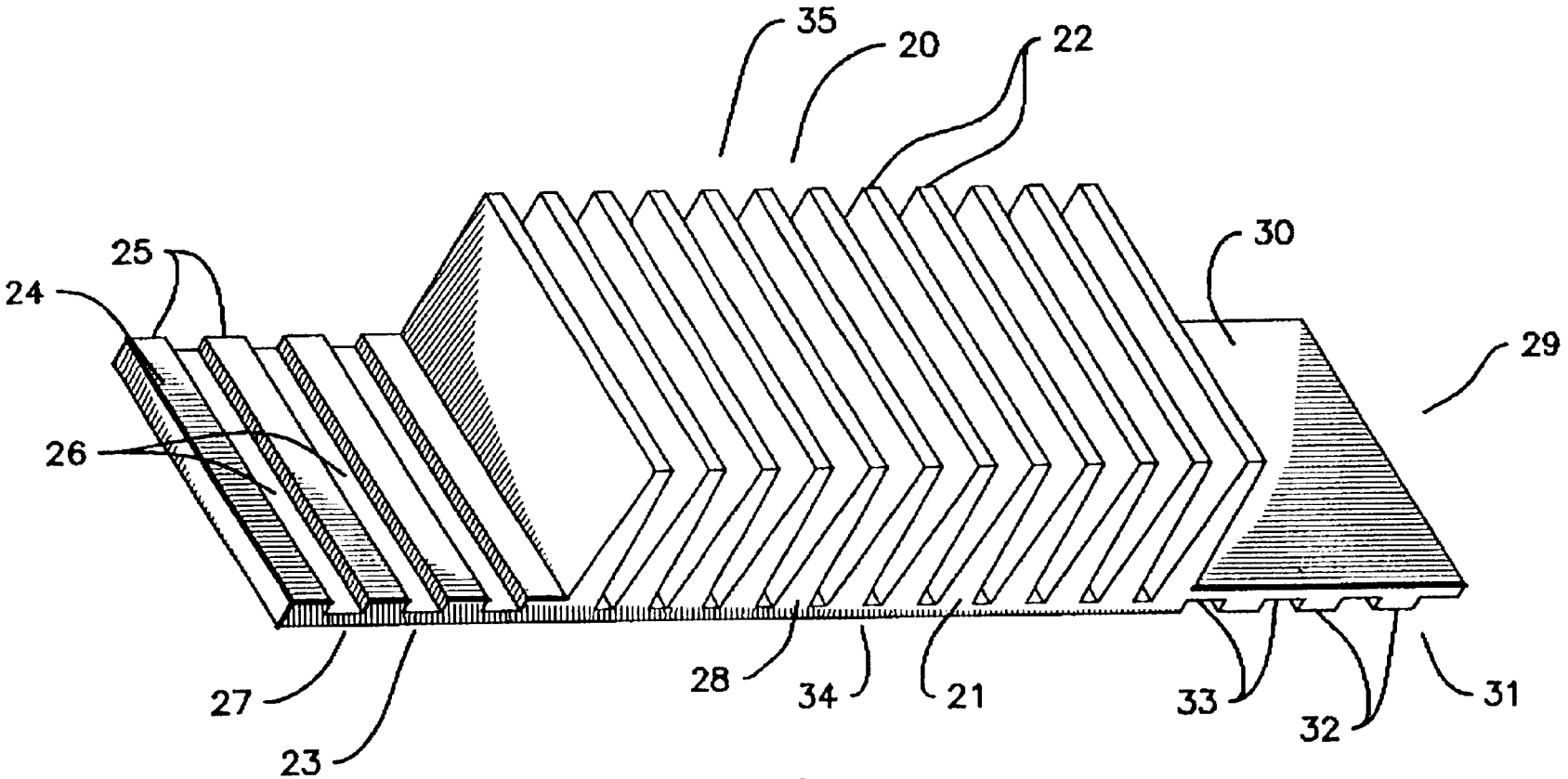
FIG. 4 is an isometric view of another preferred embodiment, a wrap-around finned damper, seen from the top.
Figure 5:
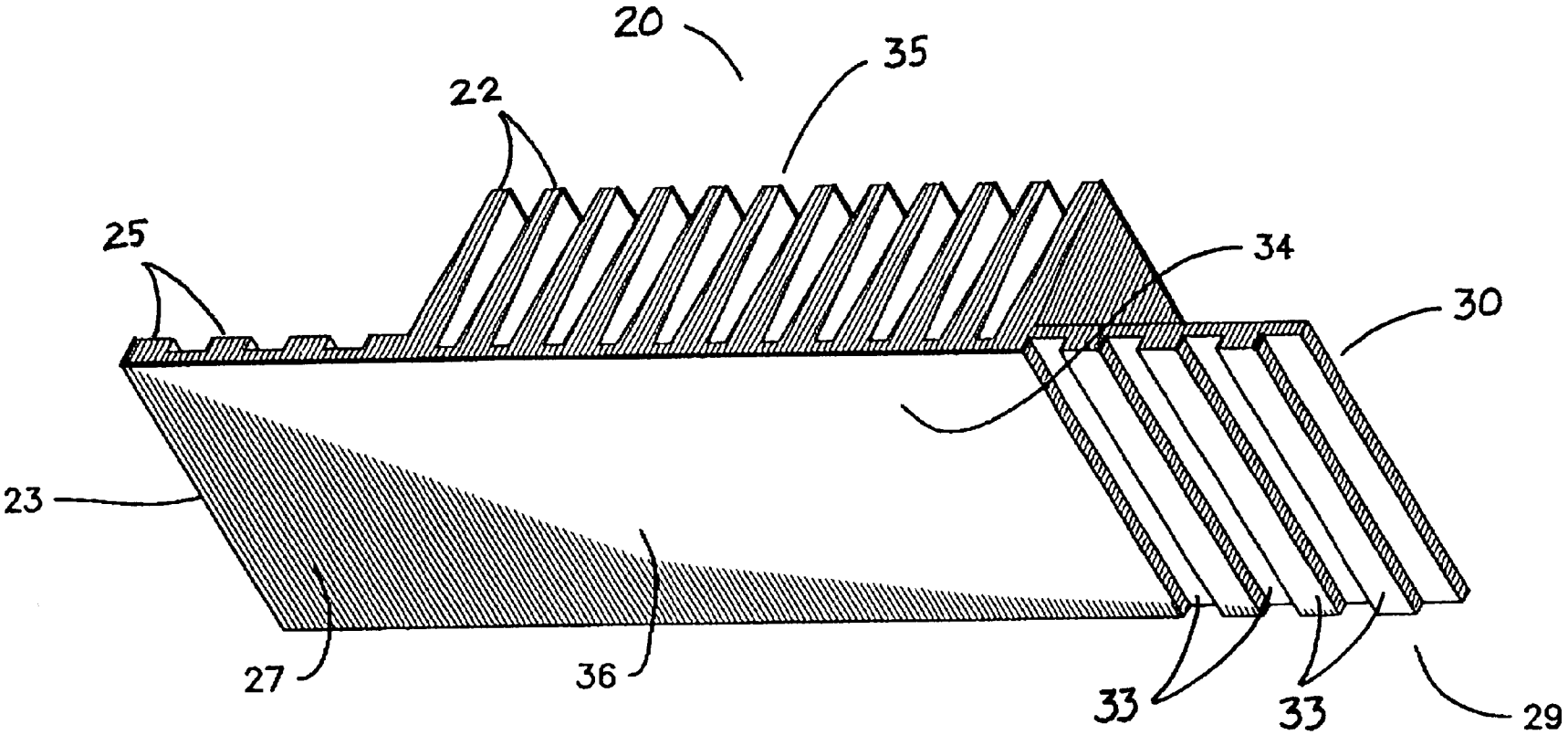
FIG. 5 is another isometric view of the preferred embodiment of the wrap-around finned damper, seen from the bottom.
Figure 6:
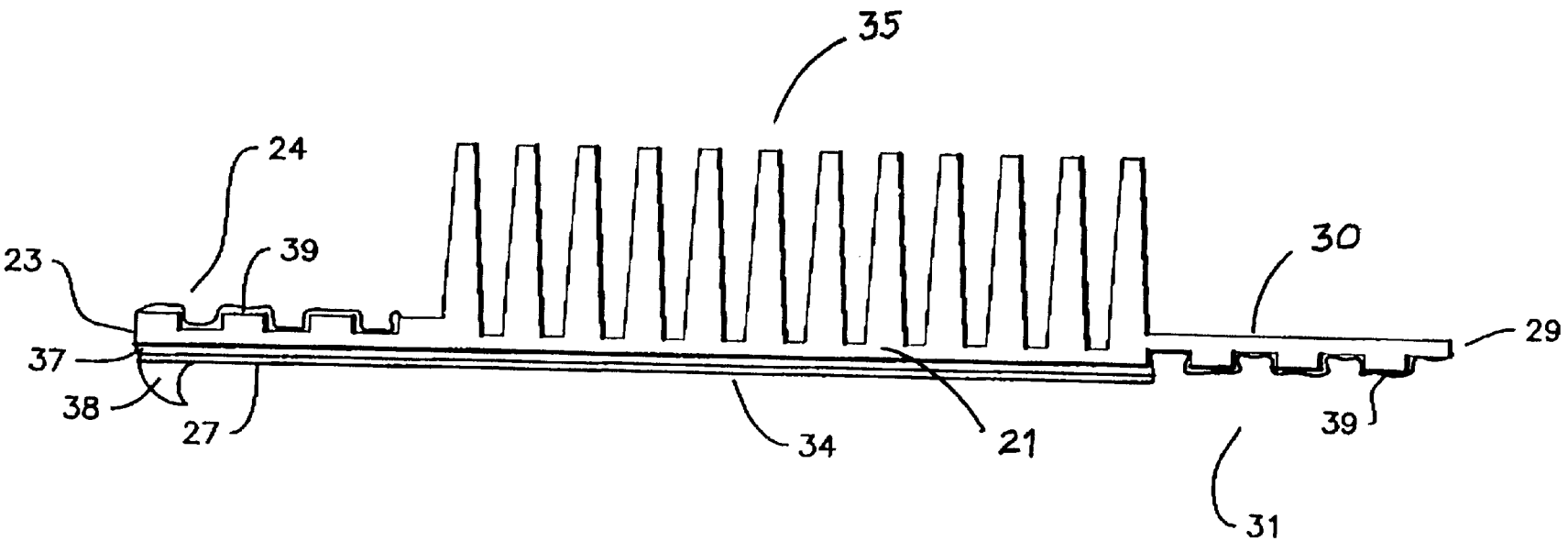
FIG. 6 is an orthogonal view of the preferred embodiment of the wrap-around finned damper, seen from the side.

FIGS. 4, 5, and 6 show another embodiment of the present invention. The finned wrap-around damper 40 is made of a resilient, elastomeric material, such as rubber, elastomer, and elastic polymers. A finned wrap-around damper 40 is molded to form a series of fins 22 on a base structure 21. Base structure 21 is further comprised of a distal lengthwise extension portion 23, a middle portion 28, and a proximal lengthwise extension portion 29. Distal lengthwise extension 23 is further divided into a top portion 24 and bottom portion 27. Top portion 24 is formed into a series of alternating raised ribs 25 and recessed grooves 26. Bottom portion 27 is a flat surface in this embodiment. Proximal lengthwise extension 29 is further divided into a top portion 30 and bottom portion 31. Top portion 30 is a flat surface in this embodiment. Bottom portion 31 is formed into a series of alternating raised ribs 32 and recessed grooves 33. At the middle portion 28 of the wrap-around damper 20, the bottom 36 is formed as a flat surface 34, and the top portion 35 is formed into the series of fins 22.

Figure 7:
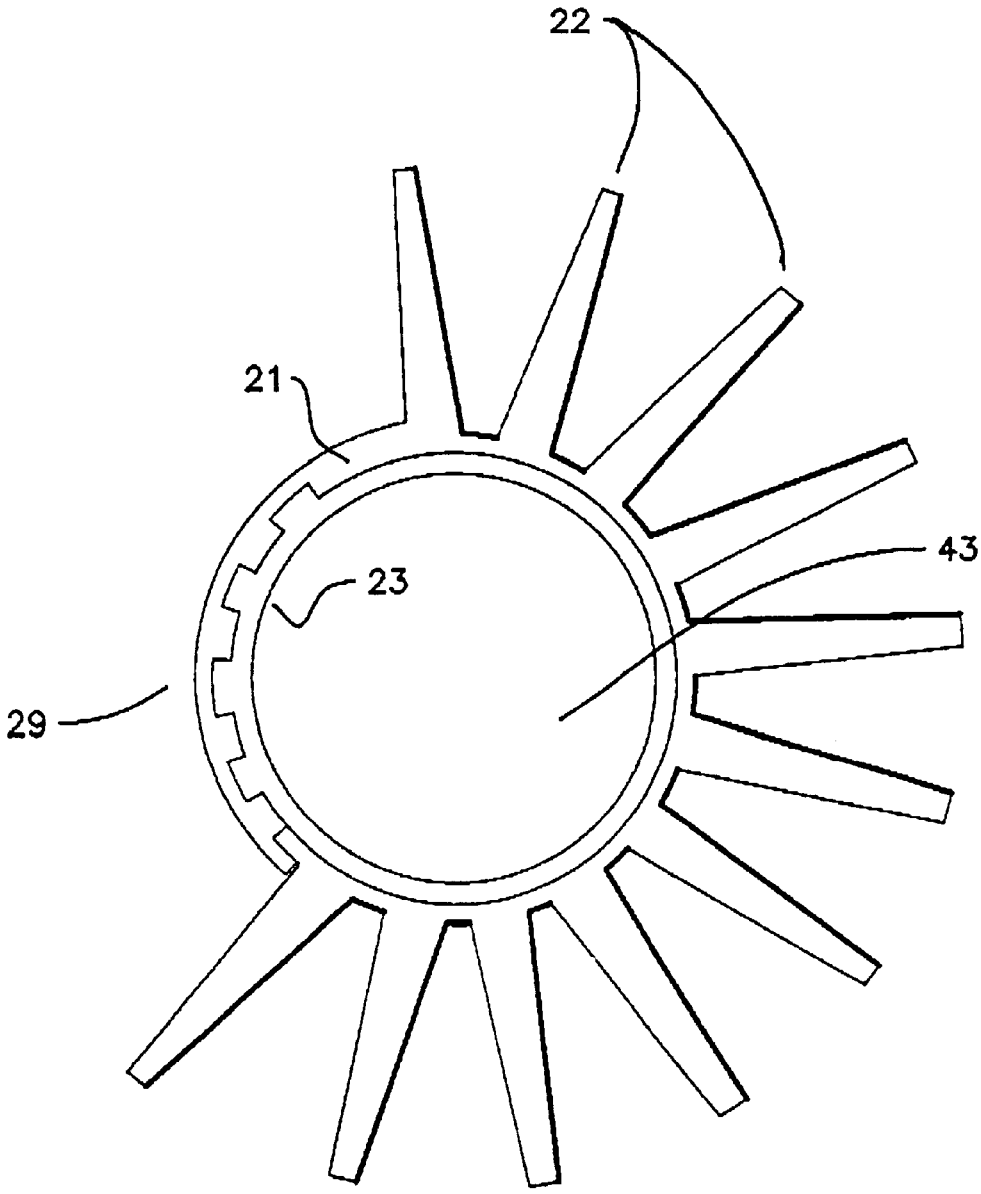
FIG. 7 is an orthogonal view of the preferred embodiment of the wrap-around finned damper, seen from the side and mounted to a cylindrical surface.

FIG. 5 is a bottom isometric view which shows the bottom 36 of base structure 21 in greater detail. Bottom portions 34 and 27 are flat surfaces, and bottom portion 31 is formed into a series of alternating raised ribs 32 and recessed grooves 33. FIG. 6 is a front orthogonal view also showing the wrap-around finned damper 20 in detail, with its fins 22, and extension portions 23 and 29 with their raised ribs 25 and recessed grooves 26 at the distal end 23, and complimentary ribs 32 and grooves 33 at the proximal end 29. The ribs 25 and grooves 26 at the distal end 23 are designed to engage the complimentary ribs 32 and grooves 33 at the proximal end. For example, FIG. 9 shows various places on an archery bow 40 where the wrap-around finned damper 20 may be fixed. Many bows 40 have mechanical dampers 43, usually cylindrical in shape, mounted to the front 46 of the bow 40 near the grip 42. Thus, as shown in greater detail in FIG. 7, the wrap-around finned damper 20 can be wrapped around a cylindrical surface, such as a mechanical damper 43, and the distal 23 and proximal 29 ends can engage the complimentary ribs, 25 and 32, and grooves, 26 and 33. As an additional example, this same type of system can also be used to fix the wrap-around damper 20 to conventional archery bow counterweights (not shown), which are also usually cylindrically shaped. As with the finned damper 10 described above, the wrap-around finned damper 20 may also be fixed to a flat surface of a bow 40. Thus, flat bottom portions, 34 and 27, can be used as surfaces to fix the damper 20 by means of glue or tape with adhesive on both sides. For example, FIG. 6 shows an adhesive layer 37, covered by a peel-off strip 38, applied to the flat bottom portions, 34 and 27. Thus, the peel-off strip 38 can be removed and the damper 20 can be fixed to any part of the bow 40, such as to a limb 41, or to a mechanical damper 43 or a counterweight (not shown). Glue or any other conventional adhesive may also be applied to the top 24 of the distal end 23, or the bottom 31 of the proximal end 29, or to both, so that the ribs 25 and grooves 26 at the distal end 23 engage the complimentary ribs 32 and grooves 33 at the proximal end and the glue holds the ends, 23 and 29, together.

Figure 8A:
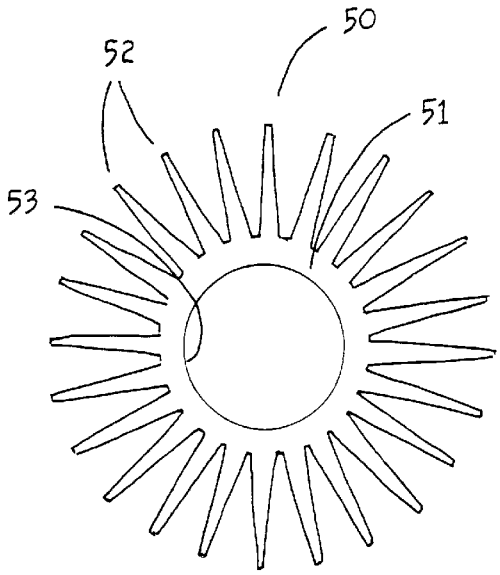
FIG. 8*a* is an orthogonal view of yet another embodiment of the invention, a finned ring damper, seen from the side and mounted to a cylindrical surface, such as a mechanical damper or counterweight.

FIG. 8*a* shows yet another embodiment of the present invention. The finned ring damper 50 is made of a resilient, elastomeric material, such as rubber, elastomer, and elastic polymers. A finned ring damper 50 is molded to form a series of fins 52 on a base structure 51. Base structure 51 forms a ring with an inner surface 53. The ring damper 50 may be mounted to any object over which it can be stretched, such as a mechanical damper 43, as seen in FIG. 9, or a counterweight (not shown). The ring damper 50 can be held in place by the friction of stretching the rubbery material over an object or by fixing it to an object with adhesive or glue, as described above.

Figure 8B:
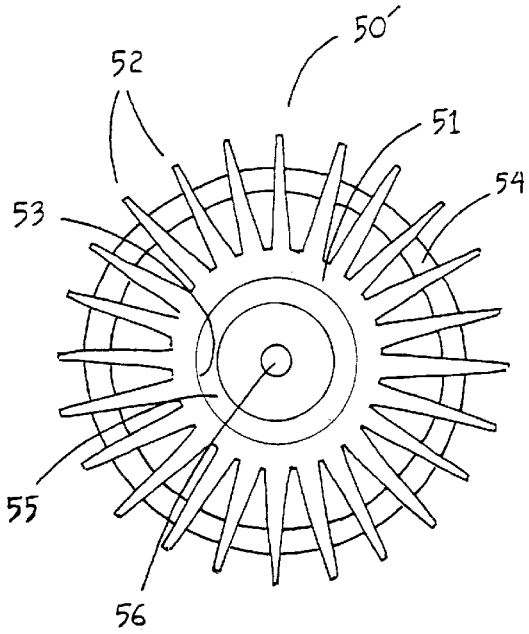
FIG. 8*b* is an orthogonal view of yet another embodiment of the finned ring damper, seen from the side.
Figure 8C:
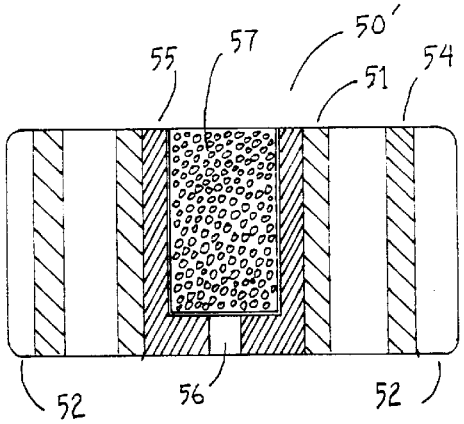
FIG. 8*c* is a cross-section side view of the finned ring damper.

FIGS. 8*b* and 8*c* show yet another embodiment of the finned ring damper. The finned ring damper 50' is made of a resilient, elastomeric material, such as rubber, elastomer, and elastic polymers. A finned ring damper 50 is molded to form a series of fins 52 on a base structure 51. Base structure 51 forms a ring with an inner surface 53. An mounting insert 55 fits into the inner surface 53 of the ring damper 50'. The mounting insert 55 is cup-shaped and has a mounting hole 56. The mounting hole 56 can receive a bolt (not shown) to secure the damper 50' to an object, such as an archery bow.

For example, as shown in FIG. 9, the limb bolts (not shown) that secure the bow limbs 41 to the grip structure 42, can be used to mount the finned damper 50' to the bow. In an additional embodiment, the cavity formed by the cup of the mounting insert 55 can be filled with a foam insert 57, for increased damping.

Figure 10:
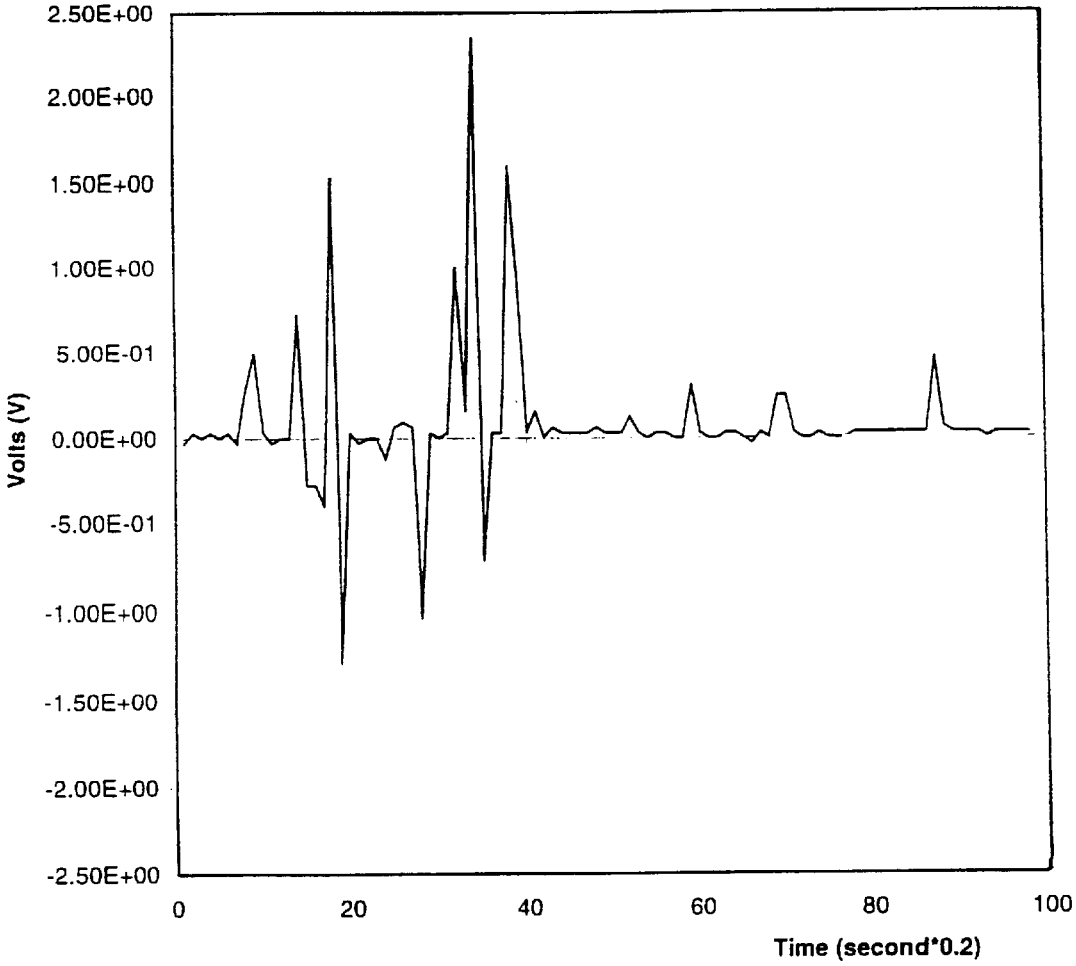
FIG. 10 is a graph showing the frequency and amplitude of vibrations in an undamped archery bow.
Figure 11:
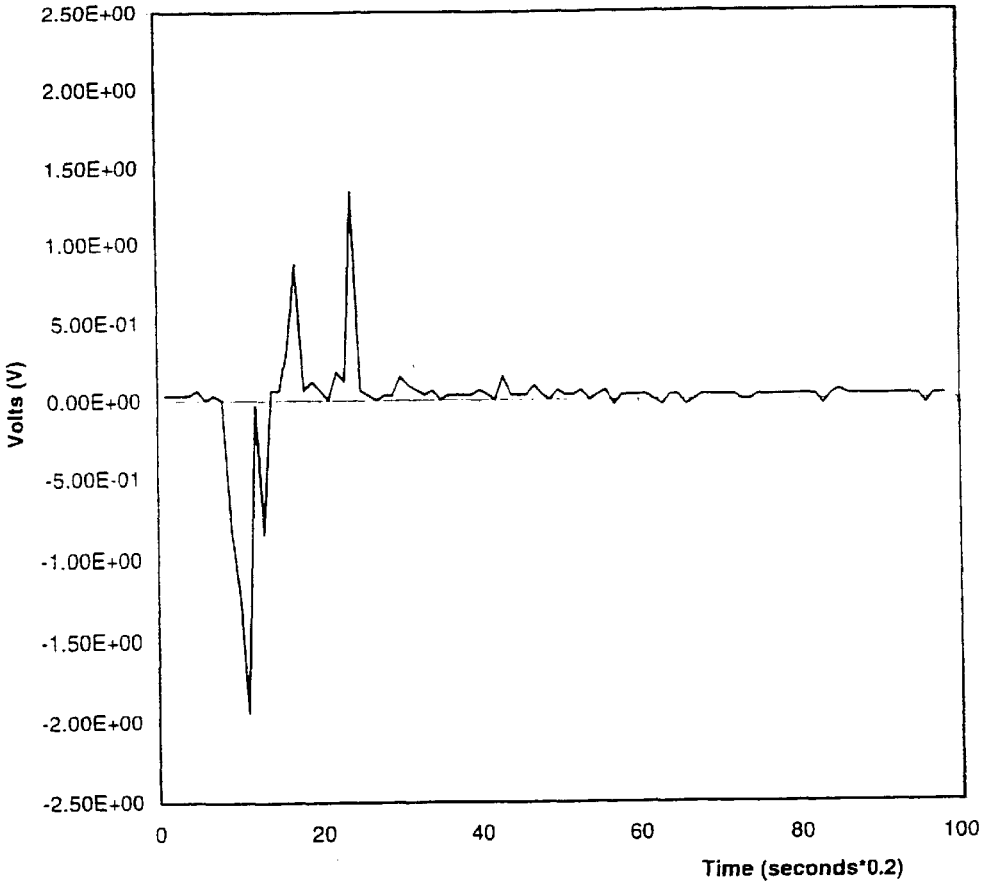
FIG. 11 is graph showing the frequency and amplitude of vibrations in an archery bow damped by an un-finned damper.
Figure 12:
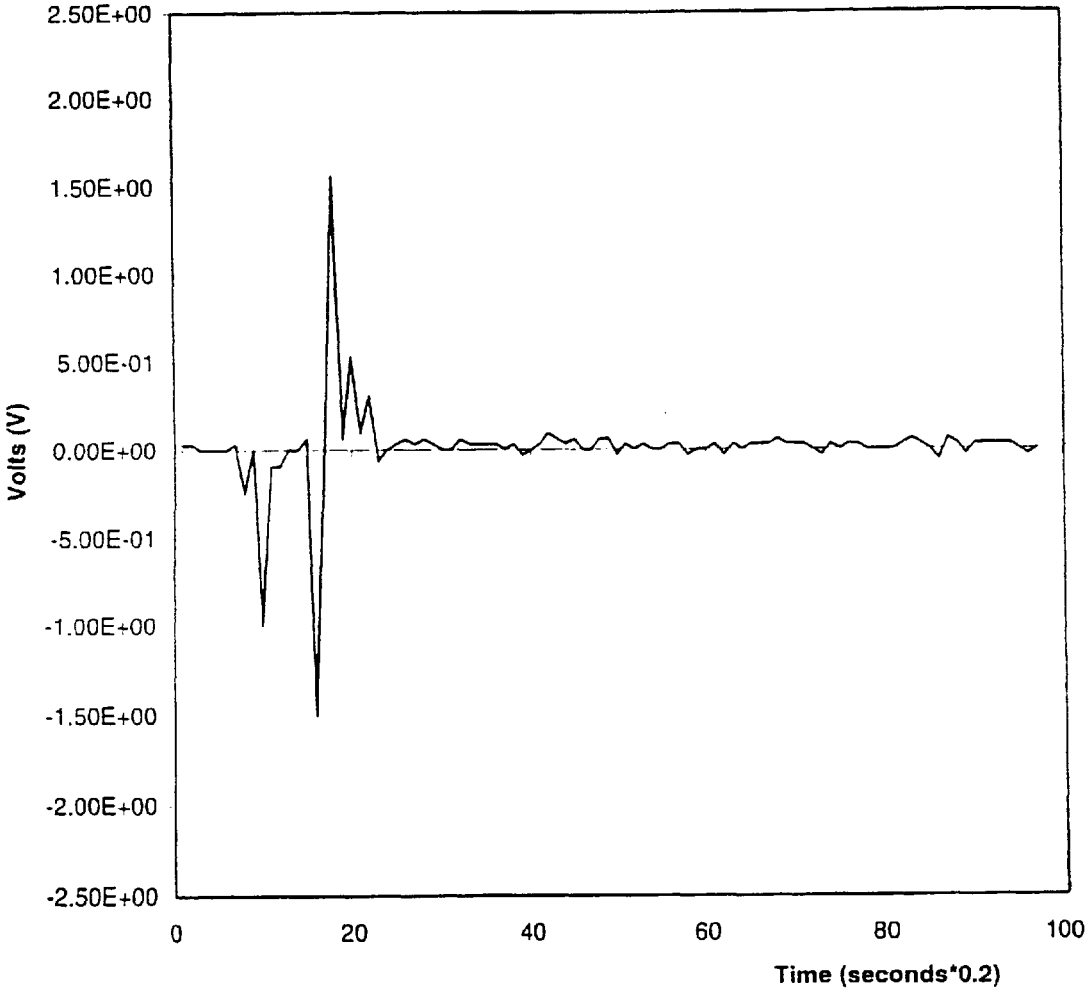
FIG. 12 is graph showing the frequency and amplitude of vibrations in an archery bow damped by the finned damper of the present invention.

The present invention provides excellent damping. FIGS. 10, 11 and 12 are graphs showing the results of experiments using an archery bow vibration testing rig at the University of Idaho College of Engineering. The testing rig holds a conventional compound archery bow and was set up to measure the duration and amplitude of vibrations generated by bowstring pulled back to its fully stretched position and released. The duration of vibrations is plotted on the horizontal axis and increments of 0.2 seconds are shown. The amplitude of vibrations is plotted on the vertical axis, measured electronically by potential and shown in increments of 0.5 volts. FIG. 10 shows is a graph of a bow without any damper. It can seen that the duration of vibrations lasts about 04. Seconds and the amplitude spikes several times, with a measured maximum of almost 2.5 volts. FIG. 11 is a graph of a currently available damper marketed and sold as an archery bow damper, substantially similar in design to the damper shown in U.S. Pat. No. 5,362,046, discussed above. The prior art damper was mounted to the test bow on the inner surface (47 in FIG. 9) of the bow limb (41 in FIG. 9), near the pulleys (48 in FIG. 9). FIG. 11 shows that the prior art damper reduces the duration of vibrations to under 0.3 second and reduces the maximum measured amplitude to just under 2.0 volts. FIG. 12 is a graph of the preferred embodiment of the present invention, as shown in FIGS. 1 through 3. The finned damper 10 of the present invention was mounted to the test bow in the same place as the prior art damper: on the inner surface (47 in FIG. 9) of the bow limb (41 in FIG. 9), near the pulleys (48 in FIG. 9). FIG. 12 shows that the finned damper of the present invention provides significantly greater damping than the prior art damper. The finned damper of the present invention reduces the duration of vibrations to about 0.15 second and reduces the maximum measured amplitude to just under 1.5 volts.

The drawings and description set forth here represent only some embodiments of the invention. After considering these, skilled persons will understand that there are many ways to make a finned vibration damper according to the principles disclosed. The inventor contemplates that the use of alternative structures, which result in a finned vibration damper using the principles disclosed and the invention claimed, will be within the scope of the claims.

I claim:

1. A vibration damping device, formed of an elastomeric material, comprising:

a base, and a plurality of substantially flat fins extending up from the base.

2. The vibration damping device of claim 1 wherein the base further comprises a flat bottom surface.

3. The vibration damping device of claim 2 wherein the bottom surface is covered by an adhesive layer, and wherein the adhesive layer has an adhesive surface to attach the vibration damping device to an object.

4. The vibration damping device of claim 3 wherein the adhesive surface is covered by a peel-off strip.

5. The vibration damping device of claim 2 wherein a bonding agent attaches the bottom surface to an object.

6. The vibration damping device of claim 1 wherein the base has a finned portion and a proximal end and a distal end, and wherein the proximal and distal ends extend beyond the finned portion.

7. The vibration damping device of claim 6 wherein the proximal and distal ends have top and bottom surfaces, and wherein the top surface of the proximal end is flat and the bottom surface of the proximal end forms a plurality of ridges and grooves, and wherein the bottom surface of the distal end is flat and the top surface of the distal end forms a plurality of ridges and grooves.

8. The vibration damping device of claim 7 wherein the base may be wrapped around an object and the ridges and grooves of the proximal and distal ends interlock.

9. The vibration damping device of claim 8 wherein a bonding agent bonds the bottom surface of the proximal end to the top surface of the distal end.

10. The vibration damping device of claim 6 wherein the base has a bottom surface extending at least under the finned portion, and wherein the bottom surface is covered by an adhesive layer, and wherein the adhesive layer has an adhesive surface to attach the vibration damping device to an object.

11. The vibration damping device of claim 10 wherein the adhesive surface is covered by a peel-off strip.

12. A vibration damping device, formed of an elastomeric material, comprising a base having a bottom surface, a finned section, and a first end and a second end, a plurality of substantially flat fins extending up from the base at the finned section, and wherein first and second ends extend beyond the finned section of the base.

13. The vibration damping device of claim 12 wherein the first and second ends have top and bottom surfaces, and wherein the bottom surface of the first end forms a plurality of ridges and grooves, and wherein the top surface of the second end forms a plurality of ridges and grooves.

14. The vibration damping device of claim 13 wherein the ridges and grooves of the second end are formed to interlock the ridges and grooves of the first end.

15. A vibration damping device, formed of an elastomeric material, for an archery bow, comprising a base having a bottom surface and a top surface, wherein the bottom surface is mounted to the archery bow and wherein the top surface has a finned section, and a plurality of substantially fins extending up from at least the finned section of the top surface of the base.

* * * * *